US005328171A

United States Patent [19]

Saito

[11] Patent Number: 5,328,171

[45] Date of Patent: * Jul. 12, 1994

[54] IRON OR WOOD GOLF CLUB

[76] Inventor: Tatsuya Saito, 4-21-4 Seijo, Setagaya-ku, Tokyo, Japan

[ * ] Notice: The portion of the term of this patent subsequent to Apr. 21, 2009 has been disclaimed.

[21] Appl. No.: 32,118

[22] Filed: Mar. 17, 1993

[51] Int. Cl.[5] ..... A63B 53/02

[52] U.S. Cl. ..... 273/80 C; 273/167 G; 273/DIG. 23

[58] Field of Search ..... 273/77 R, 77 A, 167 R, 273/167 A, 167 D, 167 F, 167 G, 167 J, 167 K, 169, 170, 171, 164.1, 80 R, 80 B, 80.1, 80.2, 80 C, DIG. 23

[56] References Cited

U.S. PATENT DOCUMENTS

| | | | |
|---|---|---|---|
| 669,864 | 3/1901 | Simpson | 273/167 G |
| 1,409,966 | 3/1922 | Plant | 273/164.1 |
| 1,705,250 | 3/1929 | Hincks | 273/167 G X |
| 1,983,158 | 12/1934 | Young | 273/80.8 X |
| 2,146,048 | 2/1939 | Barnhart | 273/80 C |
| 2,231,847 | 2/1941 | Dickson | 273/167 K |
| 2,820,638 | 1/1958 | Morrison | 273/80 C X |
| 3,424,459 | 1/1969 | Evancho | 273/80.1 |
| 3,539,184 | 11/1970 | Koorland | 273/167 G |
| 3,985,363 | 10/1976 | Jepson | 273/167 K X |
| 4,253,666 | 3/1981 | Murphy | 273/80.1 |
| 4,836,545 | 6/1989 | Pompa | 273/80 B |
| 4,869,507 | 9/1989 | Sahm | 273/171 |
| 4,872,683 | 10/1989 | Doran | 273/171 X |
| 4,954,198 | 9/1990 | Viellard | 273/80 R X |
| 5,106,088 | 4/1992 | Saito | 273/167 G X |

*Primary Examiner*—Vincent Millin
*Assistant Examiner*—Sebastiano Passaniti
*Attorney, Agent, or Firm*—Steven M. Rabin

[57] ABSTRACT

An iron or wood golf club head 60 designed to strike a golf ball so that it flies straight in a desired direction. The golf club head 60 consists generally of a striking surface 61, including a leading edge 62, and a hosel member 65, which provides a socket for insertion of a shaft member 69. The hosel member 65, connected to the striking surface 61, extends from the club head 60 substantially perpendicular to the leading edge and bends at an obtuse angle relative to the hosel portion which is connected to the striking surface 61. A straight type shaft 69 is inserted into a socket of the hosel member 65.

17 Claims, 5 Drawing Sheets

IRON OR WOOD GOLF CLUB

BACKGROUND OF THE INVENTION

1. Field of the Invention

The present invention relates generally to a golf club head or a golf club using the same, and more particularly, to a golf club known as an iron or wood, which is designed to strike a golf ball so that it flies straight in a desired direction.

2. Description of the Related Art

A typical set of golf clubs includes a putter and several clubs that are generally referred to as "woods" and "irons." A golfer selects a particular club for a given shot according to the distance to the hole and the "lie" of the golf ball. Each club in the set is designed for hitting the ball a particular distance and from a particular lie. However, in striking the golf ball, many golfers have difficulty consistently hitting the ball straight in a desired direction, and this difficulty may be a function of the particular structure of the conventional golf club head.

The configuration of the conventional golf club head makes it difficult to effectively transfer force through the club to the golf ball. In particular, the force transmitted from the golfer's swing tends to distribute unevenly across the face of the club, with greater force in the heel member and less force in the toe member. The uneven distribution of force and resulting moment forces make it difficult to control the orientation of the club head, and as a result, the ball tends to deviate from the desired direction upon impact and/or during flight, causing shots that may be termed "push", "pull", "slice", and "hook".

Attempts have been made to compensate for the uneven distribution of moment forces.

Such an attempt has included improving the hosel member to have an approximately perpendicular angle relative to the leading edge proposed by the same applicant of the present invention and filed as "Iron or Wood Golf Club" on Nov. 9, 1990, now granted as U.S. Pat. No. 5,106,088.

SUMMARY OF THE INVENTION

It is an object of the present invention to provide an iron or a wood golf club designed to strike a golf ball so that it flies straight in a desired direction without causing shots in the terms of "push", "pull", "slice", "hook" and the like.

It is another object of the present invention to provide a golf club enabling use of a shaft member made from such materials that can be difficult to be bent.

It is still another object of the present invention to provide a golf club showing excellent operability in playing and productability in manufacturing.

The present invention provides a golf club head having a striking surface, including a leading edge, and a hosel member connected to the striking surface; a first portion of the hosel member extending substantially perpendicular from the striking surface relative to the leading edge and a second portion of the hosel member extending from the first portion at an obtuse angle relative to the first hosel portion.

The substantially orthogonal relationship between the leading edge of the striking surface and the first portion of the hosel member, thus gives rise to substantially uniform forces across the face of the club head, giving the golfer greater control over the club and increasing the likelihood that the ball will fly straight in a desired direction. The present invention provides a golf club which can employ a straight type shaft, giving the manufacturer greater flexibility over the selection of materials used for the shaft.

BRIEF DESCRIPTION OF THE DRAWINGS

Referring to the Figures, wherein like numerals represent like parts throughout the several views.

DETAILED DESCRIPTION OF THE PREFERRED EMBODIMENT

Figure 1:
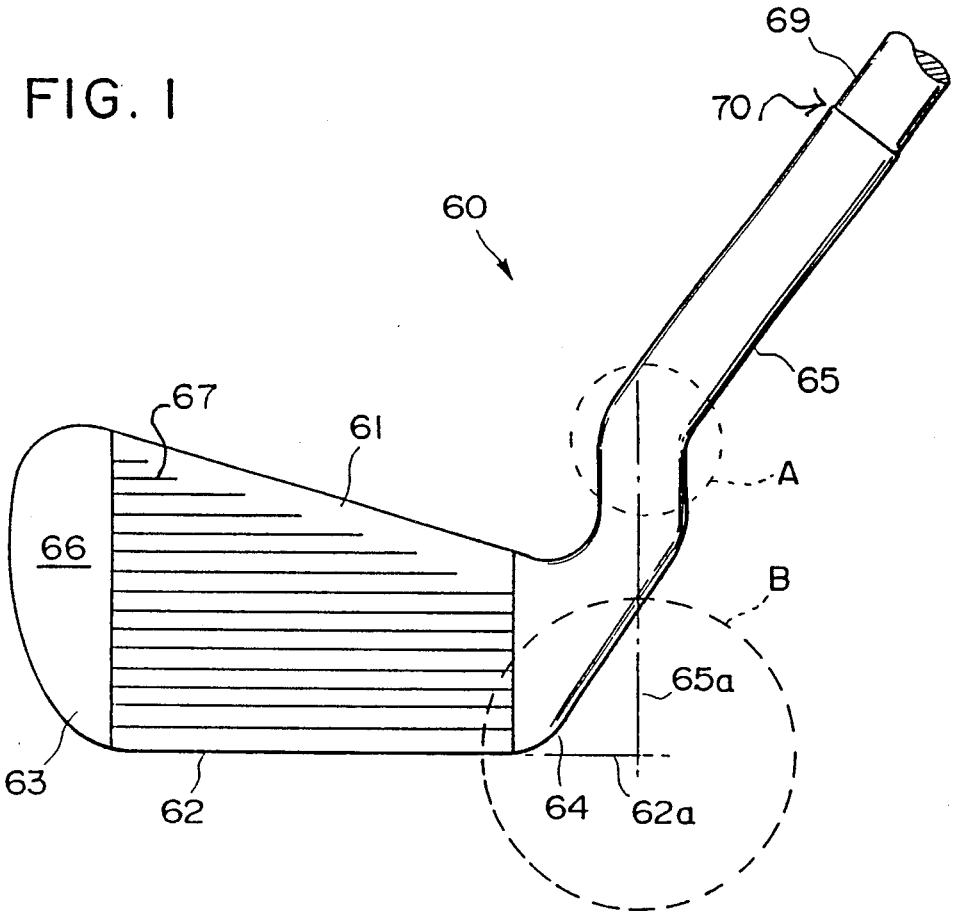
FIG. 1 is a front view of a preferred embodiment of a golf club head according to the present invention.

Referring to FIG. 1, a preferred embodiment of a golf club head according to the present invention, is designated at a numeral 60.

The golf club head 60 includes a lofted striking surface 61 having a leading edge 62. A toe member 63 and a heel member 64 are integrally connected to opposite ends of the striking surface 61, and a hosel member 65 is integrally connected to the end of heel member 64 remote from the striking surface 61. The golf club head 60 has a face 66, which comprises the visible portions of the striking surface 61 having horizontal grooves 67, the toe member 63 and the heel member 64, as shown in FIG. 1. The hosel member 65, which provides a socket into which a shaft member 69 is inserted, extends vertically upward from the heel member 64 at a substantially perpendicular 90° angle relative to an extension line of the horizontal leading edge 62. The hosel member 65 and shaft member 69 together form an elongated member 70 connected at one end to the end of the heel member 64.

The hosel member 65 is further bent toward a horizontal direction and extended, at a desired intermediate portion A thereof, shown as an imaginary cylinder in FIG. 1, with a prescribed lie angle relative to the leading edge 62.

Accordingly, the shaft 69, which is inserted into the socket provided at the end of hosel member 65, can be made from materials not only steel but those containing carbon, boron, titanium or the like therein which are normally difficult to be bent. The insertion of the shaft 69 into the hosel member 65 can be performed in a conventional way without requiring particular or special techniques. Thus, conventional shaft members can also be used. According to the invention, since the shaft member 69 is not required to be made from materials which are easy to bend in manufacturing, the shaft member 69 can be chosen from among a wide variety of materials featuring suitable lightness and stiffness for a golf shaft, and does not cause any disadvantage in being attached to the hosel member 65.

Figure 5:
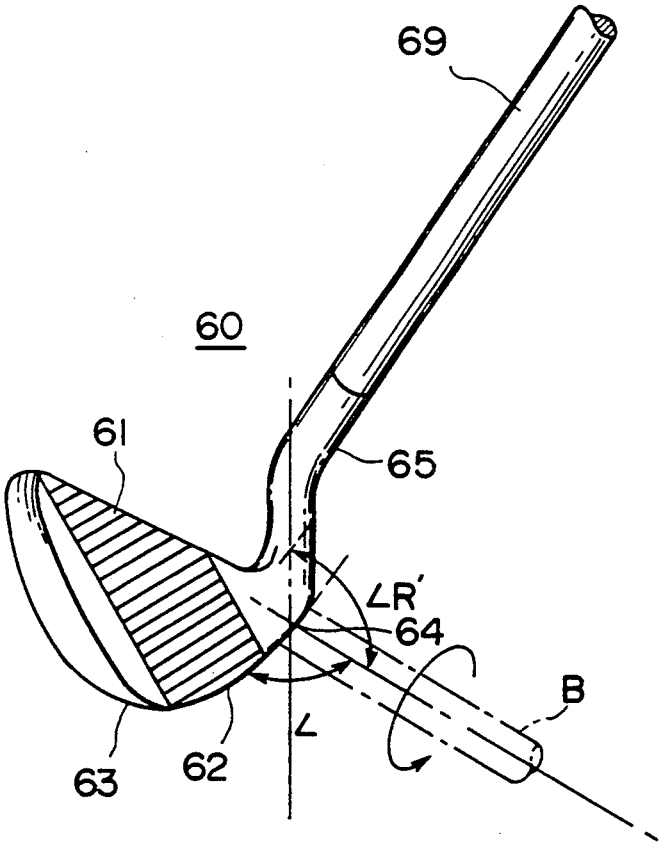
FIG. 5 is a perspective view of the golf club head of FIG. 1.

FIG. 5 is a perspective view illustrating a golf club in which the shaft 69 is attached to the golf club head 60 shown in FIG. 1.

The substantially orthogonal relationship between the hosel member 65 and the leading edge 62 increases the likelihood that the ball will fly straight in the desired direction when struck. Applicant offers the following paragraphs as explanation.

Figure 2:
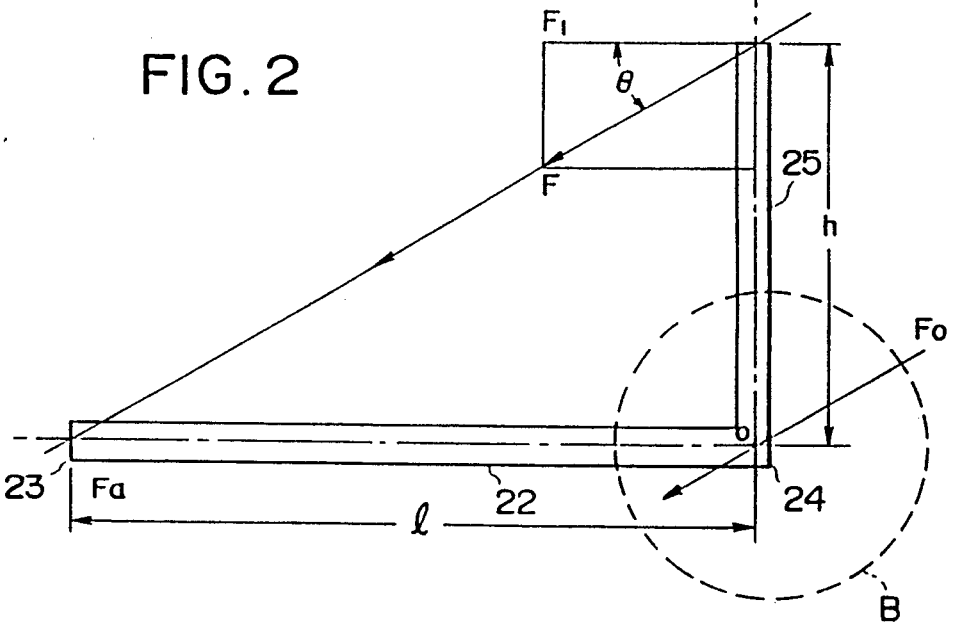
FIG. 2 is a schematic illustration of the theoretical distribution of force at points from the toe (63) to the heel (64) along the golf club head of FIG. 1.

Referring to FIG. 2, $F_1$=the horizontal component of centrifugal force F in the club head 60 when the golf club is swung downward "through" a golf ball;

h=the height of the hosel member 65 as measured relative to the leading edge 62 from the extension line 62*a* of the leading edge 62 to the position A shown in FIG. 1; and l=the length of leading edge 62 as measured relative to center line 65*a* of hosel member 65 and $$\tan\theta = \left(\frac{h}{l}\right)$$

$F_\alpha$=the downward directed force generated at the leading edge 62

Varying l to measure the force at points along the leading edge 62, $$f_1 = F_1\frac{h_1}{l_1} = \frac{h_1}{l_1}F\cos\theta = F\cdot\left(\frac{h_1}{l_1}\cdot\cos\theta\right)$$

Figure 3:
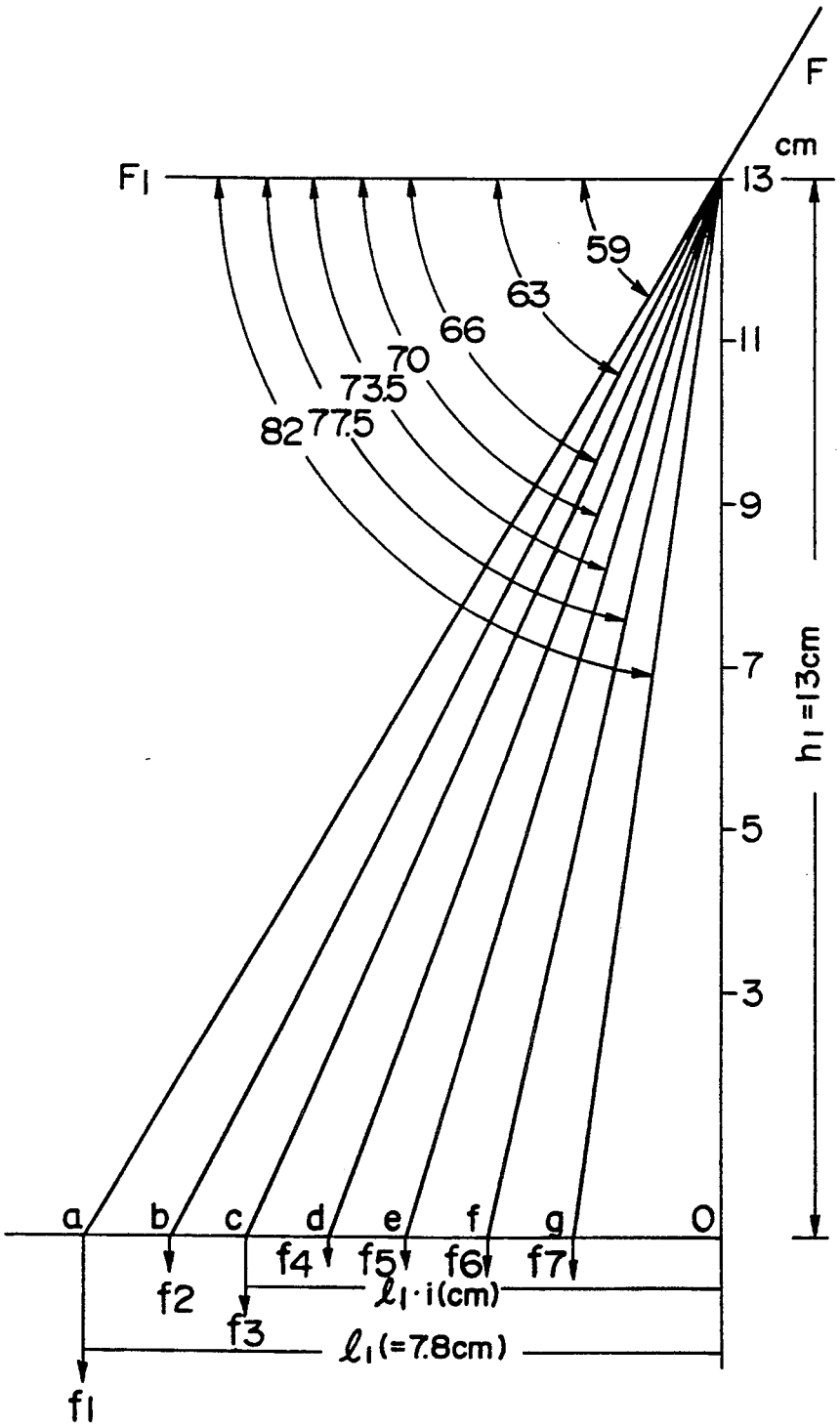
FIG. 3 is a schematic illustration of the theoretical distribution of downward force at points from the toe (a) to the heel (g) along the leading edge of the golf club head of FIG. 1.

$F_1 = F\cos\theta$ and
$M = h\cdot F_1 = h\cdot F\cos\theta$. At the O point in FIG. 2,
$M = h(=o)\cdot F\cos\theta = 0$ Referring to FIG. 3, $$f_1 = F_1\frac{h_1}{l_1} = \frac{h_1}{l_1}F\cos\theta = F\cdot\left(\frac{h_1}{l_1}\cdot\cos\theta\right)$$

$$M = F\cdot h_1 = h_1\cdot l_1$$

$$f_i = F\cdot\left(\frac{h_1}{l_{1-i}}\cdot\cos\theta_1\right)$$

Provided, i=1–7 (such that 1 is varied to correspond to points along the leading edge 62); and $f_i$=downward force along the leading edge 62.

$$f_{1-7} = F\cdot\left(\frac{h}{l_{1-7}}\cdot\cos\theta_{1-7}\right)\text{and where } h = 13,$$

$$f_1 = F\cdot\left(\frac{13}{7.8}\cdot\cos 59^\circ\right) = F\cdot(1.67\times 0.515)\approx 0.86F$$

$$f_2 = F\cdot\left(\frac{13}{6.8}\cdot\cos 63^\circ\right) = F\cdot(1.91\times 0.454)\approx 0.87F$$

-continued $$f_3 = F\cdot\left(\frac{13}{5.8}\cdot\cos 59^\circ\right)66 = F\cdot(2.24\times 0.407)\approx 0.91F$$

$$f_4 = F\cdot\left(\frac{13}{4.8}\cdot\cos 70^\circ\right) = F\cdot(2.70\times 0.347)\approx 0.91F$$

$$f_5 = F\cdot\left(\frac{13}{4.8}\cdot\cos 73.5^\circ\right) = F\cdot(3.42\times 0.284)\approx 0.97F$$

$$f_6 = F\cdot\left(\frac{13}{2.8}\cdot\cos 77.5^\circ\right)66 = F\cdot(4.64\times 0.216)\approx 1.00F$$

$$f_7 = F\cdot\left(\frac{13}{1.8}\cdot\cos 70^\circ\right) = F\cdot(7.22\times 0.139)\approx 1.00F$$

Figure 4:
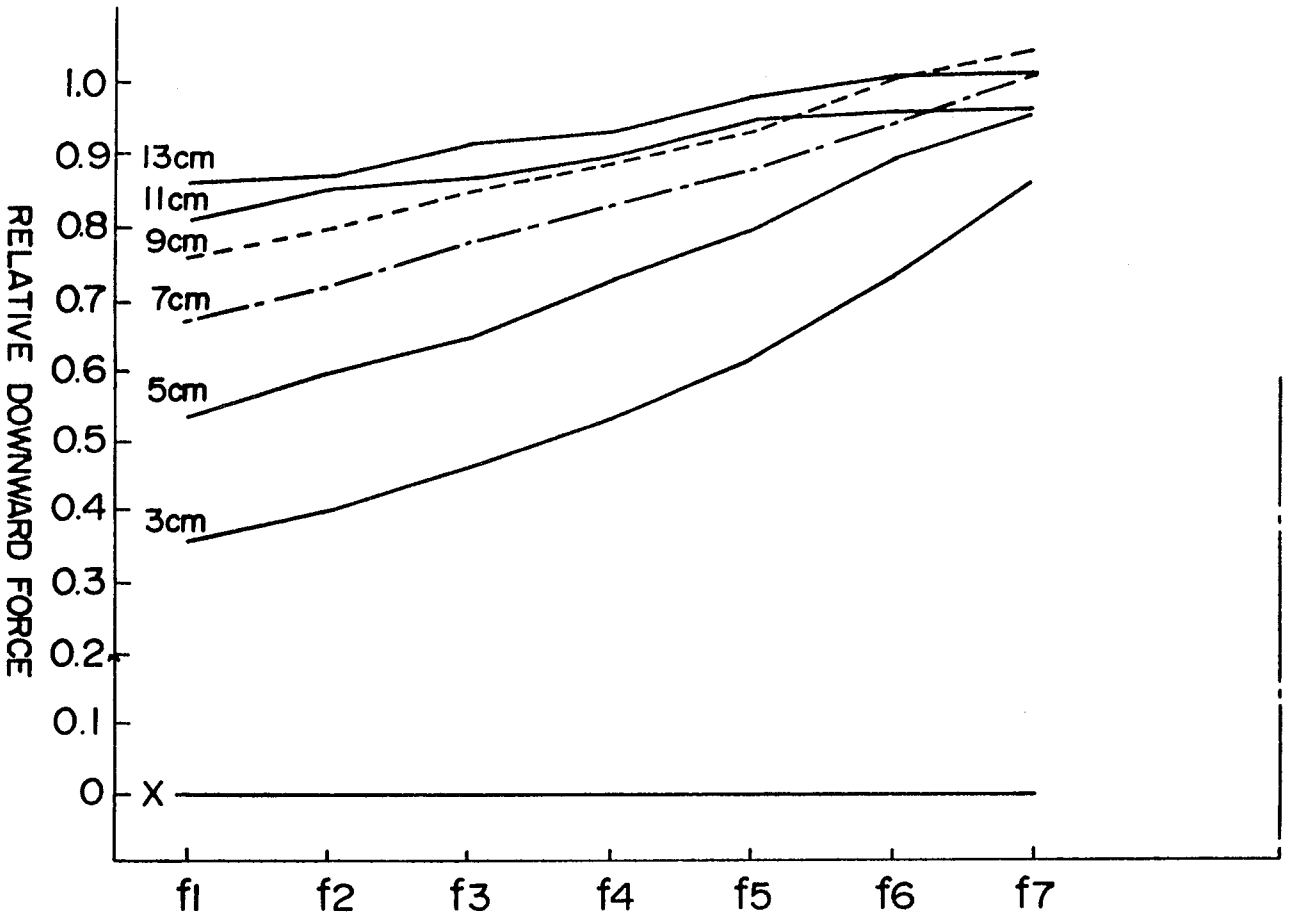
FIG. 4 is a graph of the relative values of downward force at points from the toe ($f_1$) to the heel ($f_7$) along the leading edge of the golf club head of FIG. 1, for hosel members ranging in length from 3 cm to 13 cm from the leading edge (62) to the bend in the portion (A)

As shown in FIG. 4, which plots the relative downward force along points $f_1$–$f_7$ of the leading edge 62 for hosel members being varying in height from 3 cm to 13 cm from the leading edge 62 to the bend of the portion A, there are relatively constant downward forces along the leading edge 62 of the golf club head 60 of the present invention. The relatively consistent downward forces act to limit any tendency of the golf club to twist. In comparison, there are no such downward forces on the leading edge of the conventional club head (labeled as X in FIG. 4).

Referring to FIG. 5, the center of an imaginary cylinder B passes through the intersection of the center line of the hosel member 65 and the extension of the leading edge 62, such that ANGLE $R^1$ is equivalent to ANGLE R. The moment shown about the imaginary cylinder B corresponds to the moment upon the club head 60 generated by swinging the club. The almost perpendicular relationship between the hosel member 65 and the leading edge 62 causes the moment force to be distributed over the entire golf club head 60.

A golf club fitted with the golf club head 60 of the present invention is less likely to twist in the golfer's hands due to the moment force generated over the entire golf club head 60, and the relatively evenly distributed downward forces, which press against the ground substantially uniformly across the leading edge 62. Thus, a golfer using such a club is more likely to strike the ball in such a manner that the ball flies straight in a desired direction.

Figure 6:
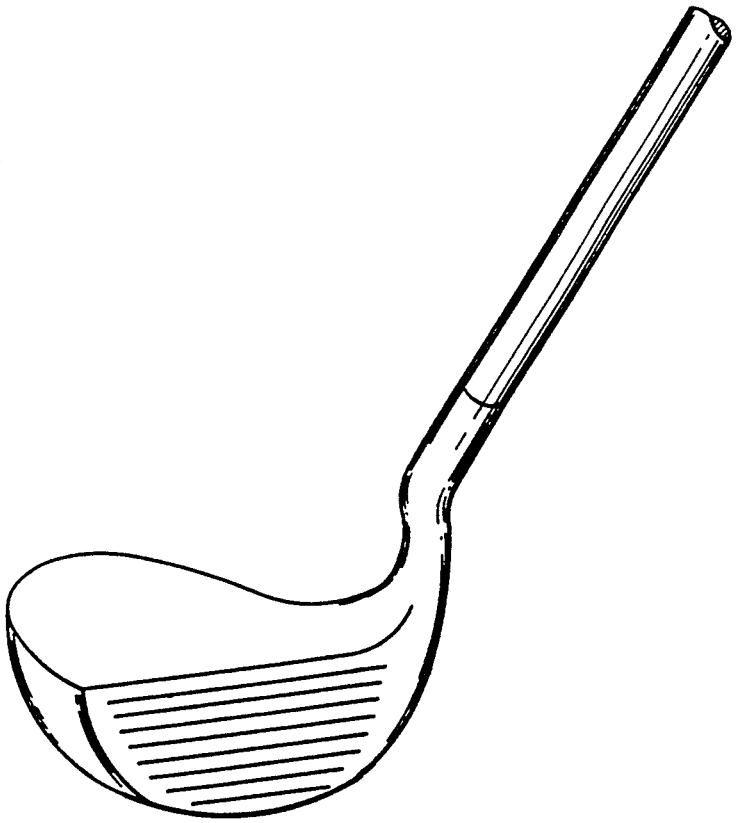
FIG. 6 is a perspective view of another embodiment of a wood type golf club head according to the present invention.

FIG. 6 is a perspective view illustrating a wood club according to the present invention, in which the gists of the invention are same as those described in the above embodiment illustrating the iron club. Since the wood club, in particular in comparison with the iron club, is required to strike a golf ball straight and further in a desired direction with a stable swing, wide variety of selection can be made as materials, from which the shaft is manufactured, among those containing therein carbon, boron, titanium and the like.

While the present invention has been described with regard to a preferred embodiment, it is not to be limited thereby, but only by the appended claims.

What is claimed is:

1. In a golf club other than a putter, the golf club including a club head having a lofted striking surface, the striking surface having a horizontal leading edge, the club head having a heel at one end of the striking surface, the golf club further including a hosel member connected to an end of said heel remote from the striking surface, the improvement wherein a substantially orthogonal relationship exists between the leading edge and a vertically extending first hosel portion of the hosel member, and the hosel member has a bend proximate the first hosel portion and away from the club head, the first hosel member being between the heel and the bend.

2. The golf club set forth in claim 1, wherein the striking surface has horizontal grooves.

3. The golf club set forth in claim 1, wherein the hosel member is bent at an obtuse angle.

4. A golf club of a type commonly known as an iron comprising:

(a) a club head, including a striking surface having a leading edge, and having a heel member at an end of the striking surface;

(b) a hosel member, including a first hosel portion and a second hosel portion formed integrally with each other; the first hosel portion being connected to an end of the heel member remote from the striking surface, and extending in an upward direction from the end of the heel member substantially perpendicularly to the leading edge; the second hosel portion extending from the first hosel portion at an obtuse angle relative to the first hosel portion; and (c) a straight shaft member secured to, aligned with, and extending away from the second hosel portion.

5. The golf club set forth in claim 4, wherein the shaft member is made from steel.

6. The golf club set forth in claim 4, wherein the shaft member is made from material containing at least one kind of material atoms selected among carbon, boron and titanium.

7. The golf club set forth in claim 4, wherein the striking surface has horizontal grooves.

8. The golf club set forth in claim 4, wherein the shaft is axially aligned with the second hosel portion.

9. A golf club of a type commonly known as a wood, comprising:

(a) a club head, including a striking surface having a leading edge, and having a heel member at an end of the striking surface;

(b) a hosel member, including a first hosel portion and a second hosel portion formed integrally with each other; the first hosel portion being connected to an end of the heel member remote from the striking surface and extending in an upward direction from the end of the heel substantially perpendicularly to the leading edge; the second hosel portion extending from the first hosel portion at an obtuse angle relative to the first hosel portion; and (c) a straight shaft member secured to, aligned with, and extending away from the second hosel portion.

10. The golf club set forth in claim 9, wherein the shaft member is made from steel.

11. The golf club set forth in claim 9, wherein the shaft member is made from material containing at least one kind of material atoms selected among carbon, boron and titanium.

12. The golf club set forth in claim 9, wherein the striking surface has horizontal grooves.

13. The golf club set forth in claim 9, wherein the shaft is axially aligned with the second hosel portion.

14. In a golf club other than a putter, the golf club including a club head having a lofted striking surface and a horizontal leading edge, the club head having a heel at one end of the striking surface, the golf club further including a hosel connected to an end of the heel remote from the striking surface and a shaft connected to the hosel, the shaft and the hosel together forming an elongated member, the improvement wherein a substantially orthogonal relationship exists between the leading edge of the striking surface and a vertically extending first portion of the elongated member, and the elongated member has a bend proximate the first portion and away from the club head, the first portion being between the heel and the bend.

15. The golf club set forth in claim 14, wherein the first portion and the bend are both entirely formed in the hosel.

16. A golf club of other than a putter, comprising:

(a) a club head, including a striking surface having a horizontal leading edge, and having a heel member at an end of the striking surface;

(b) a hosel member, including a first hosel portion and a second hosel portion formed integrally with each other; the first hosel portion being connected to an end of the heel member remote from the striking surface and extending from the end of the heel member in an upward direction so as to define a predetermined angle with the leading edge; the second hosel portion being bent toward a horizontal direction relative to the first hosel portion, so that the second hosel portion extends from the first hosel portion at an obtuse angle relative to the first hosel portion; and (c) a straight shaft member secured to, axially aligned with, and extending away from the second hosel portion.

17. The golf club set forth in claim 16, wherein the predetermined angle is a perpendicular angle so that the first portion of the hosel member extends substantially perpendicularly to the leading edge of the striking surface.

* * * * *